US009162503B2

(12) United States Patent
Monteiro et al.

(10) Patent No.: US 9,162,503 B2
(45) Date of Patent: Oct. 20, 2015

(54) MACHINE FOR PRINTING AN OBJECT WITH TILTABLE INKJET PRINTING HEADS

(71) Applicant: MACHINES DUBUIT, Noisy le Grand (FR)

(72) Inventors: Rui Monteiro, Gagny (FR); François Dumenil, Chaumes en Brie (FR)

(73) Assignee: MACHINES DUBUIT, Noisy le Grand (FR)

( * ) Notice: Subject to any disclaimer, the term of this patent is extended or adjusted under 35 U.S.C. 154(b) by 0 days.

(21) Appl. No.: 14/448,094

(22) Filed: Jul. 31, 2014

(65) Prior Publication Data

US 2015/0035897 A1 Feb. 5, 2015

(30) Foreign Application Priority Data

Jul. 31, 2013 (FR) ..... 13 57600

(51) Int. Cl.

| | |
|---|---|
| ***B41J 25/308*** | (2006.01) |
| ***B41J 3/407*** | (2006.01) |
| ***B41J 25/316*** | (2006.01) |
| ***B41J 2/14*** | (2006.01) |

(52) U.S. Cl.

CPC *B41J 25/316* (2013.01); *B41J 2/14* (2013.01); *B41J 3/4073* (2013.01)

(58) Field of Classification Search

CPC .... B41J 25/308; B41J 25/316; B41J 25/3088; B41J 25/34

See application file for complete search history.

(56) References Cited

U.S. PATENT DOCUMENTS

| | | | | |
|---|---|---|---|---|
| 8,262,198 | B2 * | 9/2012 | Ishii et al. | 347/40 |
| 2001/0003871 | A1 | 6/2001 | Patton et al. | |
| 2006/0221127 | A1 * | 10/2006 | Lee | 347/42 |
| 2007/0095218 | A1 | 5/2007 | Strange | |
| 2009/0284566 | A1 * | 11/2009 | Suzuki et al. | 347/38 |
| 2013/0271517 | A1 * | 10/2013 | Leoni et al. | 347/6 |

FOREIGN PATENT DOCUMENTS

| | | | |
|---|---|---|---|
| FR | 2908076 | A1 | 5/2008 |
| JP | 2011230315 | A * | 11/2011 |
| WO | 2004/016438 | A1 | 2/2004 |

(Continued)

OTHER PUBLICATIONS

Machine generated, English translation of JP2011-230315 "Drawing Device" to Wanibe Akihasa; translation obtained via http://www19.ipdl.inpit.go.jp/PA1/cgi-bin/PA1INDEX on Jan. 9, 2015; 9pp.*

(Continued)

*Primary Examiner* — Shelby Fidler

(74) *Attorney, Agent, or Firm* — Knobbe Martens Olson & Bear LLP

(57) ABSTRACT

A machine for printing an object includes: a chassis, at least four inkjet printing heads respectively suitable for orienting jets of ink toward the object in at least four printing directions, and a system for maintaining and moving printing heads fastened on the chassis and suitable for moving the printing heads between a number of positions relative to the chassis. The system is suitable so that, in each of the number of positions, the printing directions are separate from one another and pass through a same central axis (C). The central axes correspond to the number of positions respectively situated at a number of distances (D) from the chassis.

11 Claims, 7 Drawing Sheets

(56) References Cited

FOREIGN PATENT DOCUMENTS

| | | | | |
|---|---|---|---|---|
| WO | 2011/095865 A2 | | 8/2011 | |
| WO | WO2013/181836 | * | 12/2013 | ..... B41J 3/407 |

OTHER PUBLICATIONS

Search Report dated Mar. 24, 2014 in corresponding FR application No. 1357600.

* cited by examiner

MACHINE FOR PRINTING AN OBJECT WITH TILTABLE INKJET PRINTING HEADS

CROSS-REFERENCE TO RELATED APPLICATION

This application claims priority to French Patent Application No. 13 57600 filed on Jul. 31, 2013, the disclosure of which including the specification, the drawings, and the claims is hereby incorporated by reference in its entirety.

BACKGROUND OF THE INVENTION (1) Field of the Invention

The present invention relates to a machine for printing an object, the printing machine including:

a chassis, at least four inkjet printing heads respectively suitable for directing jets of ink toward the object in at least four printing directions, and a system for maintaining and moving printing heads fastened on the chassis and suitable for moving the printing heads between a plurality of positions relative to the chassis.

(2) Description of Related Art

In order to print the surface of the cylindrical object with a circular base, it is known to use inkjet printing heads. Each printing head comprises orifices or nozzles suitable for orienting parallel jets of ink toward the object in a printing direction perpendicular to the object.

The printing heads are positioned radially around the object. The printing heads pass through the axis of the object. In other words, they are perpendicular to the surface of the object to be printed.

Application FR-A-2,908,076 teaches an adaptation of the printing machine to different cylindrical objects with a given axis having increasing radii. The printing machine includes a system for maintaining and moving the printing heads making it possible to separate the printing heads from each other, the printing directions passing through the axis of the object. The larger the radius of the object to be printed is, the farther the printing heads are from each other. The system for maintaining and moving the printing heads has dimensions adapted to the maximum radius of the objects to be printed.

Thus, in order to print cylindrical objects with a large diameter, the machine includes a large system for maintaining and moving the printing heads. Such a machine is therefore relatively bulky and expensive.

Furthermore, such a machine is not suitable for printing cylindrical objects with an oval base, the local curvature of which varies.

One aim of the invention is therefore to provide a printing machine suitable for cylindrical objects with a large diameter, while having a more moderate cost than the printing machines of the prior art.

BRIEF SUMMARY OF THE INVENTION

To that end, the invention relates to a printing machine of the type described above, in which the system is suitable so that, in each of the positions of said plurality, the printing directions are separate from one another and pass through a same central axis, the central axes corresponding to the plurality of positions respectively situated at a plurality of distances from the chassis.

According to particular embodiments, the printing machine comprises one or more of the following features, considered alone or according to any technically possible combinations:

the system is suitable for placing the printing heads in at least one position relative to the chassis in which the printing directions are substantially parallel to each other;

the system is suitable so that, in each of the positions of said plurality, the printing directions are distributed angularly around the central axis with a constant angle pitch;

the system comprises: at least four supports on which the four printing heads are respectively fastened, at least two main axes substantially parallel to each other and secured to the chassis, two of the four supports being rotatably mounted around the two main axes relative to the chassis, respectively, at least two connecting rods rotatably mounted relative to the chassis around the two main axes, respectively, at least two moving axes substantially parallel to the two main axes, the moving axes being mounted rotatably relative to the chassis in the two connecting rods, respectively, the other two of the four supports respectively being secured to the two moving axes, and a drive assembly to rotate at least one of the connecting rods around one of the main axes relative to the chassis;

the system comprises at least one regulating assembly suitable, when the connecting rod driven by the drive assembly pivots by an angle $\alpha$ relative to the chassis around the main axes, for pivoting the moving axis mounted in the driven connecting rod, the moving axis pivoting by an angle $\alpha/2$ relative to the driven connecting rod;

the regulating assembly comprises at least one pinion secured to the main axis around which the driven connecting rod pivots, and at least one toothed sector secured to the moving axis mounted in the driven connecting rod, the toothed sector meshing on the pinion and having a diameter equal to twice the diameter of the pinion;

the system comprises at least one securing assembly suitable for the supports to be secured to one another in rotation around the two main axes and the two moving axes relative to the chassis, respectively;

the securing assembly comprises at least four gears respectively secured to the four supports, the four gears having substantially the same diameter and successively meshing in one another;

the system is configured so that at least two of the printing heads [are] offset relative to one another along the central axis, such that one of said two heads is capable of extending a pattern, along the central axis, applied on the object by the other two printing heads;

the system is configured so that said two printing heads are offset relative to one another along the central axis by a distance such that said two printing heads are capable of printing contiguous patterns on the object; and the system is suitable for moving the printing heads collectively between the positions of said plurality of positions.

BRIEF DESCRIPTION OF THE SEVERAL VIEWS OF THE DRAWINGS

The invention will be better understood upon reading the following description, provided solely as an example and done in reference to the appended drawings, in which.

DETAILED DESCRIPTION OF THE INVENTION

Figure 1:
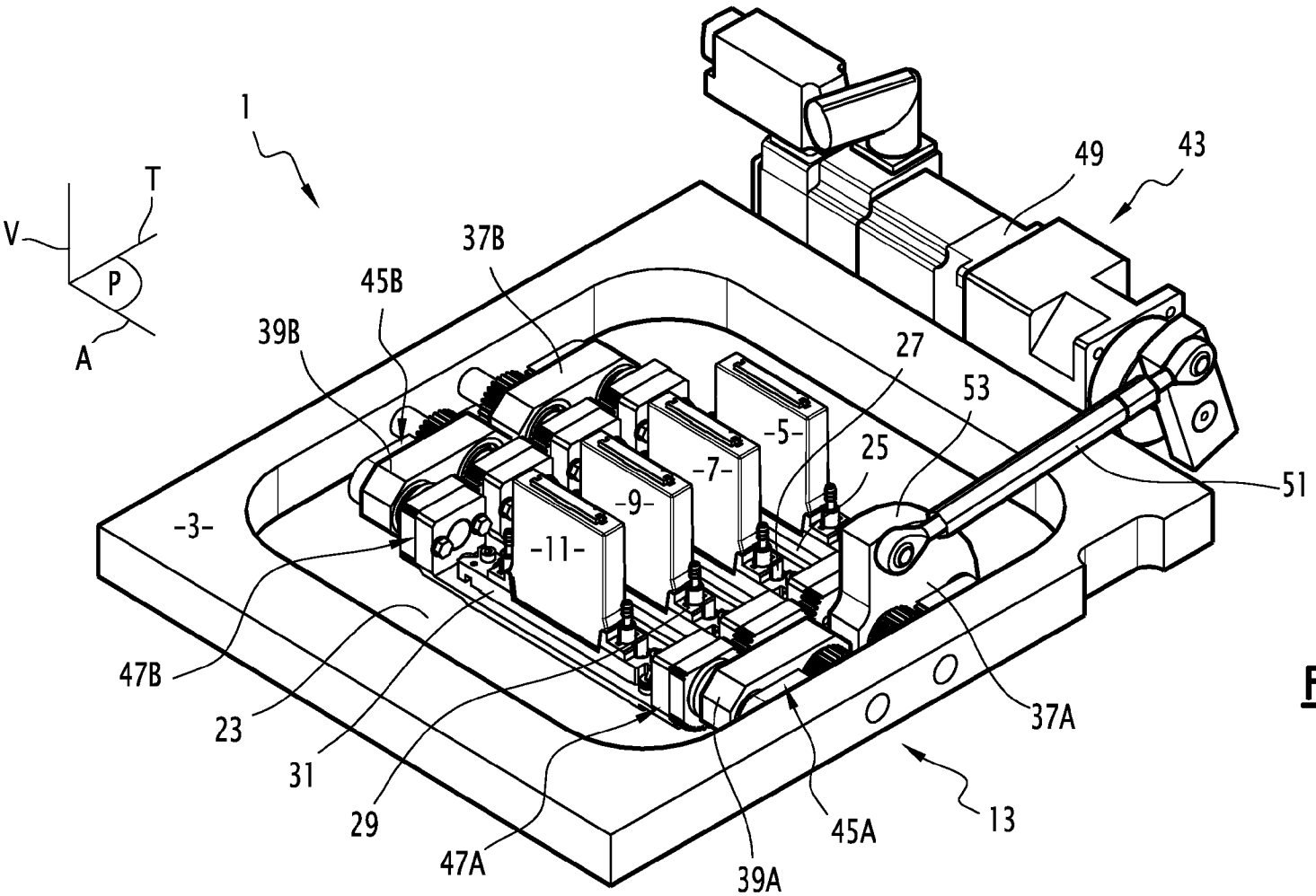
FIG. 1 is a perspective view of a printing machine according to the invention, the printing heads being in a position in which the printing directions are parallel to each other.

A printing machine 1 according to the invention is described in reference to FIGS. 1 to 5. The printing machine 1 comprises a chassis 3, at least four inkjet printing heads 5, 7, 9, 11, and a system 13 for maintaining and moving printing heads fastened on the chassis.

The printing machine 1 is suitable for printing an object 15 (FIG. 3) having a substantially planar surface 17. The printing machine 1 is also suitable for printing an object 19 (FIG. 5) having a substantially cylindrical surface 21 and a central axis C.

The objects 15 and 19 are situated below the printing machine 1 in the illustrated example.

The object 15 is for example supported by an object holder (not shown) suitable for translating the object 15 relative to the chassis 3 in a transverse direction T.

The object 19 is for example supported by an object holder (not shown) suitable for rotating the object 19 around a central axis C relative to the chassis 3. The object 19 for example has a radius greater than or equal to 15 mm.

Figure 2:
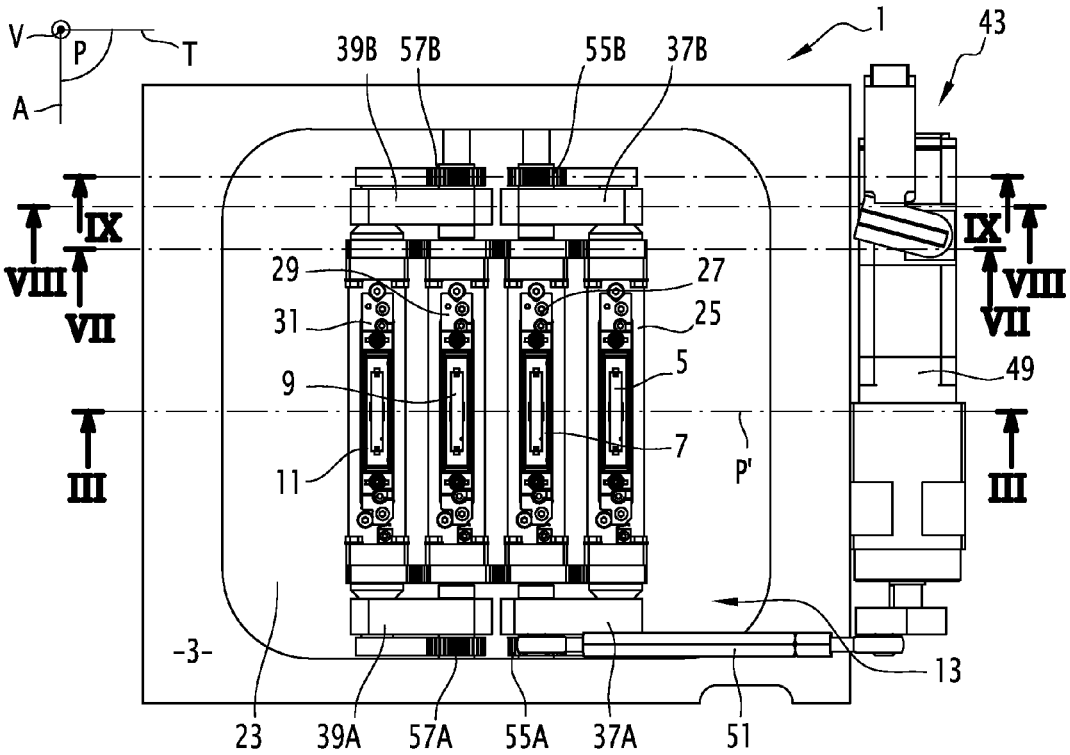
FIG. 2 is a top view of the printing machine shown in FIG. 1.

The chassis 3 has a generally square or rectangular shape (FIG. 2). The chassis 3 extends along a plane P that is substantially horizontal in the illustrated example. The chassis 3 defines an opening 23 in a direction V substantially perpendicular to the transverse direction T.

The direction V is substantially vertical in the illustrated example.

The opening 23 has a generally square or rectangular shape. The opening 23 receives part of the system 13 and the printing heads 5, 7, 9, 11.

The printing heads 5, 7, 9, 11 are for example similar to each other. For example, they are respectively dedicated to one base color so as to produce four-color process prints on the object 15, 19.

According to one alternative, the printing heads 5, 7, 9, 11 are respectively dedicated to a same color, for example white, in order to produce a coating on the objects 15, 19.

The printing heads 5, 7, 9, 11 respectively define printing directions D1, D2, D3, D4 (FIGS. 3 and 5), in which the printing heads are respectively capable of orienting jets of ink (not shown) toward the objects 15, 19.

The ink jets of each of the printing heads 5, 7, 9, 11 are substantially parallel to each other.

Figure 4:
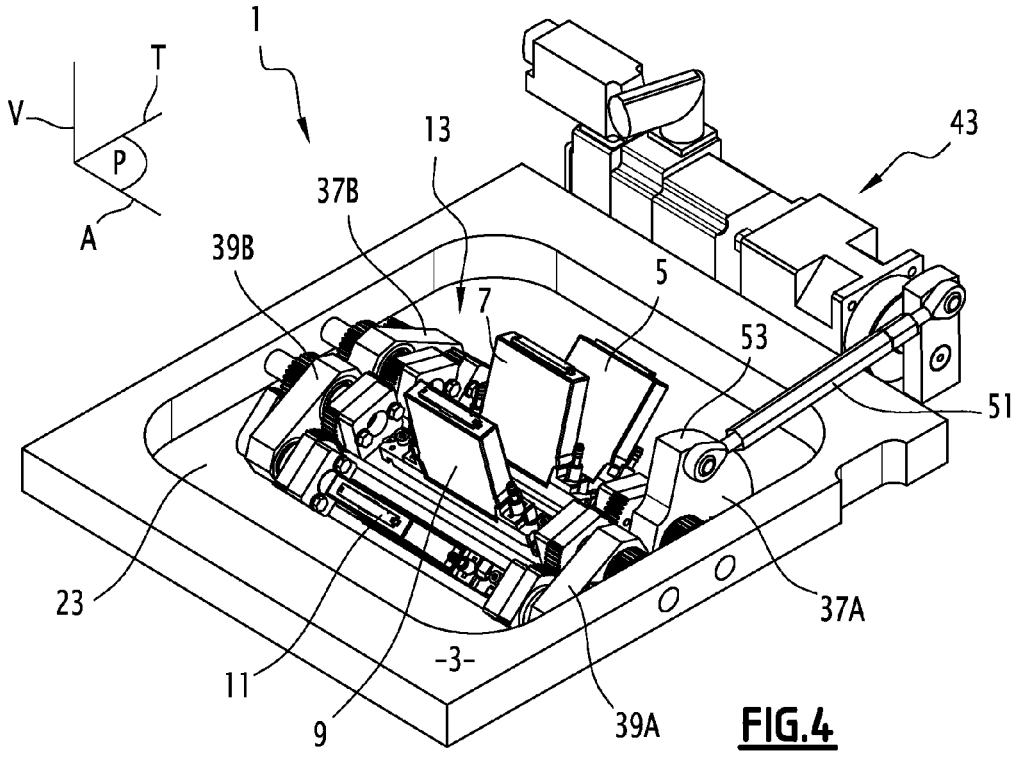
FIG. 4 is a perspective view of the printing machine shown in FIGS. 1 to 4, the printing heads being in a position in which the printing directions pass through a central axis.
Figure 5:
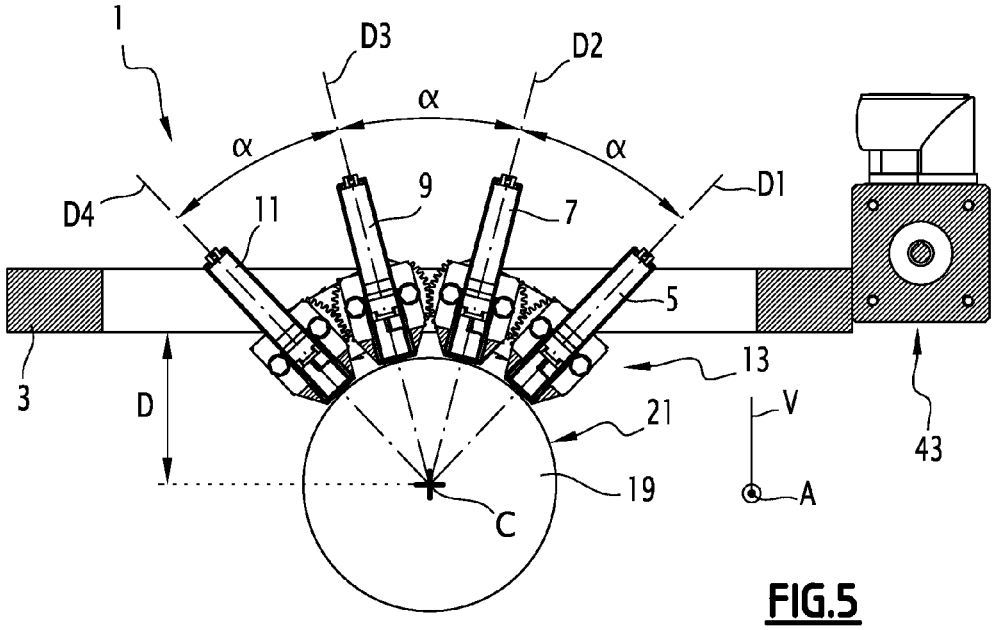
FIG. 5 is a front view of the printing machine shown in FIGS. 1 to 4, in cross-section in the same vertical plane as for FIG. 3, the printing heads being in the position shown in FIG. 4.

The system 13 is suitable for moving the printing heads 5, 7, 9, 11, for example collectively, between a plurality of positions relative to the chassis 3, similar to that shown in FIGS. 4 and 5.

As shown in FIG. 5, irrespective of the considered position of said plurality of positions, the system 13 is suitable for the printing directions D1, D2, D3, D4 to be distinct from one another and pass through the central axis C.

The central axis C is situated at a distance D from the chassis 3. The central axis C is substantially parallel to an axial direction A.

The axial direction A is substantially perpendicular to the printing directions D1, D2, D3, D4. The axial direction A is substantially perpendicular to the direction V and the transverse direction T.

The distance D is characteristic of the position in question from among said plurality.

In the illustrated embodiment, the system 13 is further suitable, in each of the positions of said plurality, like that shown in FIG. 5, for the printing directions D1, D2, D3, D4 to be distributed angularly around the central axis C by an angle $\alpha$ with a constant pitch.

The system 13 is suitable so that the distance D selectively assumes any value for example greater than 15 mm. Advantageously, the system 13 is suitable for the distance D to selectively assume an arbitrarily large value.

The system 13 is further suitable for placing the printing heads 5, 7, 9, 11 in an arc of circle (FIG. 5) around the object 19.

Figure 3:
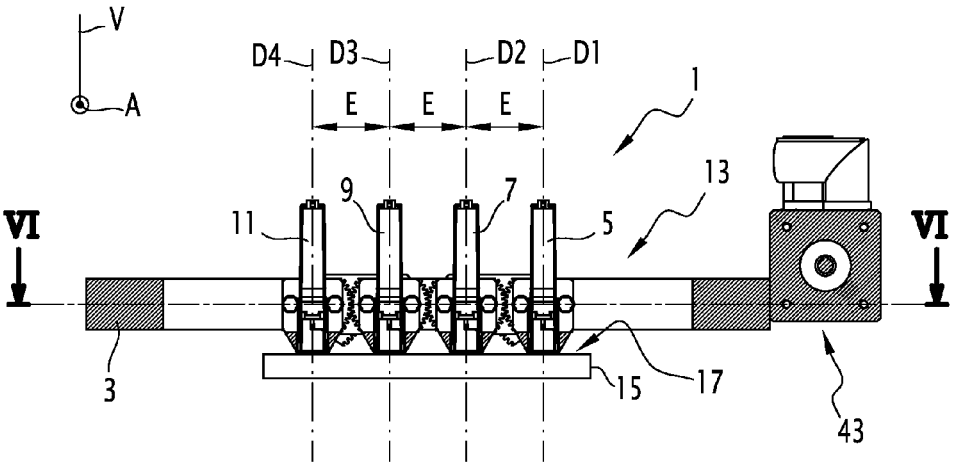
FIG. 3 is a front view of the printing machine shown in FIGS. 1 and 2, in cross-section in a vertical plane.

The system 13 is further suitable for placing the printing heads 5, 7, 9, 11 in at least one position relative to the chassis 3, shown in FIGS. 1 to 3, in which the printing directions D1, D2, D3, D4 are substantially parallel to each other.

The position shown in FIG. 3 is separate from the plurality of positions similar to that shown in FIG. 5. It will be understood that the position shown in FIG. 3 is in fact a boundary case for the plurality of positions. In this boundary case, the central axis C is situated at an infinite distance D from the chassis 3, and the angle pitch $\alpha$ is zero.

The system 13 is further suitable for the angle $\alpha$ to selectively assume values comprised between 0° and 60°, advantageously all values comprised between 0° and 60°.

Figure 6:
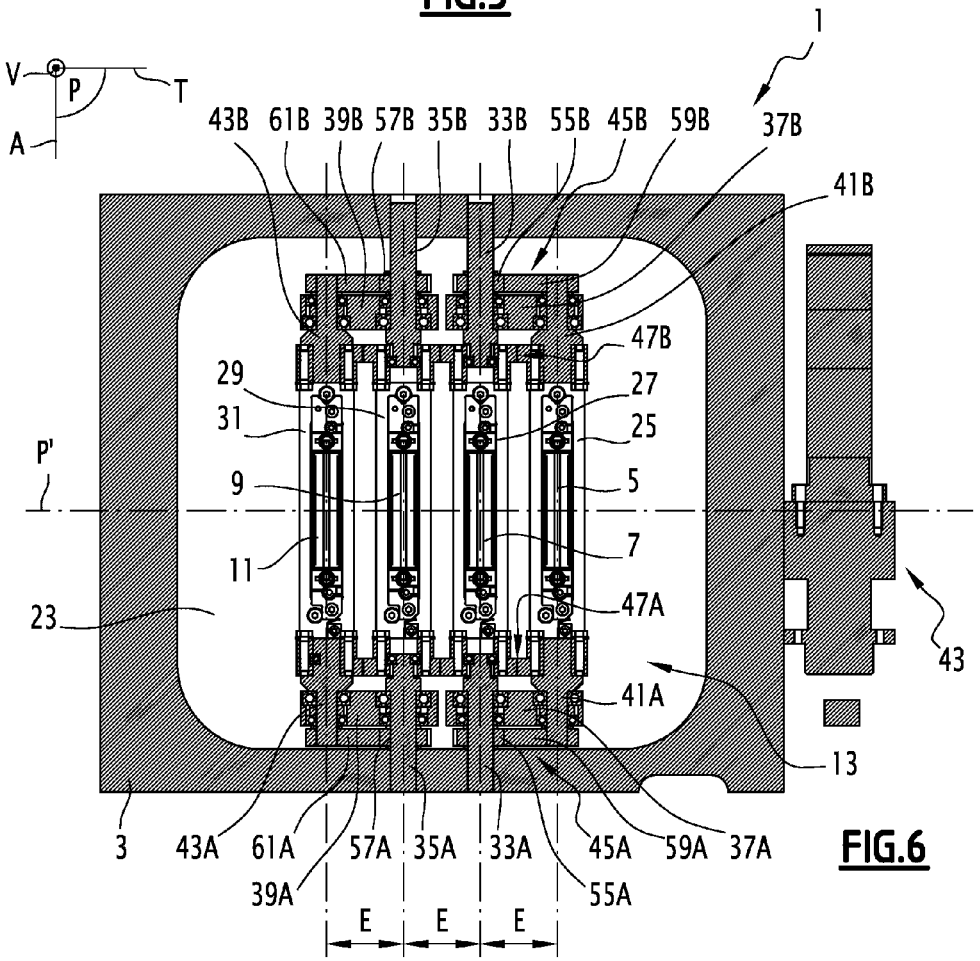
FIG. 6 is a cross-section of the printing machine shown in FIGS. 1 to 5 in a horizontal plane visible in FIG. 3, the printing heads being in the position shown in FIG. 1.

As shown in FIG. 6, the system 13 comprises four supports 25, 27, 29, 31 on which the four printing heads 5, 7, 9, 11 are respectively fastened, and four main axes 33A, 33B, 35A, 35B secured to the chassis 3 and parallel to the axial direction A. The system 13 also comprises four connecting rods 37A, 37B, 39A, 39B rotatably mounted relative to the chassis 3 around four main axes 33A, 33B, 35A, 35B, respectively, and four moving axes 41A, 41B, 43A, 43B substantially parallel to the axial direction A and rotatably mounted on the connecting rods 37A, 37B, 39A, 39B, respectively.

The system 13 further comprises a driving assembly 43 for rotating the connecting rod 37A around the main axes 33A relative to the chassis 3. The system 13 also comprises two regulator assemblies 45A, 45B for controlling the rotation of the moving axis 41A around itself, and two securing assemblies 47A, 47B for securing the four supports 25, 27, 29, 31 in rotation relative to one another.

In the system 13, the elements referenced by numbers followed by the letter A are substantially symmetrical to the elements referenced by numbers followed by the letter B relative to a median plane P', with the exception of the connecting rods 37A, 37B, which are not symmetrical to each other. Consequently, only the elements of the system 13 referenced by numbers followed by the letter A will be described in more detail.

The median plane P' is perpendicular to the axial direction A.

The main axes 33A and 35A are separated by a distance E and, in the illustrated example, are situated in a same horizontal plane.

The moving axes 41A, 43A are also situated at the distance E from the main axes 33A and 35A, respectively.

Each of the supports 25, 27, 29, 31 has an elongated shape, advantageously in a cradle (FIGS. 1 and 4), in the axial direction A. The supports 25, 27, 29, 31 extend between the main axes 33A, 33B, 35A, 35B and the moving axes 41A, 41B, 43A, 43B in the axial direction A, respectively (FIG. 6).

The support 27 is rotatably mounted around the main axes 33A, 33B. The support 29 is rotatably mounted around the main axes 35A, 35B. The support 25 is secured to the moving axes 41A, 41B. The support 31 is secured to the moving axes 43A, 43B.

The drive assembly 43 (FIGS. 1 and 4) comprises a reducing gear 49, and a drive connecting rod 51 coupling the reducing gear 49 with the connecting rod 37A to rotate the connecting rod 37A around the main axis 41A relative to the chassis 3.

The connecting rod 37A includes an extension 53 on which the connecting rod 51 is rotatably mounted. The connecting rods 37B, 39A, 39B do not have such an extension.

The connecting rods 37A, 37B, 39A, 39B are configured to keep the moving axes 41A, 41B, 43A, 43B at the distance E from the main axes 33A, 33B, 35A, 35B, respectively.

Figure 9:
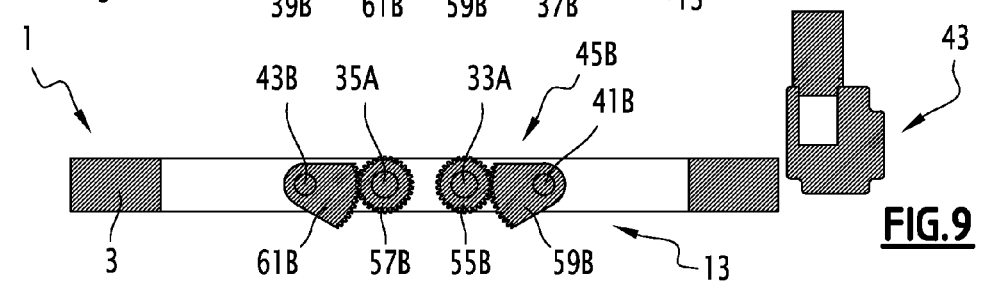

Each of the regulator assemblies 45A, 45B (FIGS. 6 and 9) respectively comprises two pinions 55A, 55B, 57A, 57B respectively secured to the main axes 33A, 33B, 35A, 35B, and two toothed sectors 59A, 59, 61A, 61B respectively secured to the moving axes 41A, 41B, 43A, 43B.

The toothed sectors 59A, 61A mesh on the pinions 55A, 57A. The toothed sectors 59A, 61A have a diameter equal to twice the diameter of the pinions 55A, 57A.

The toothed sectors 59A, 61A and the pinions 55A, 57A respectively extend between the connecting rods 37A, 39A and an inner edge of the chassis 3 in the axial direction A.

Figure 7:
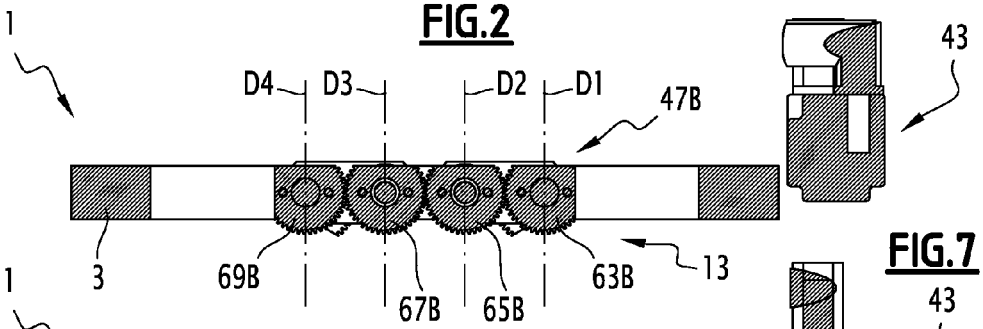
FIGS. 7 to 9 are cross-sections of the printing machine shown in FIGS. 1 to 6 in vertical planes shown in FIG. 2, the printing heads being in the position shown in FIG. 1.
Figure 8:
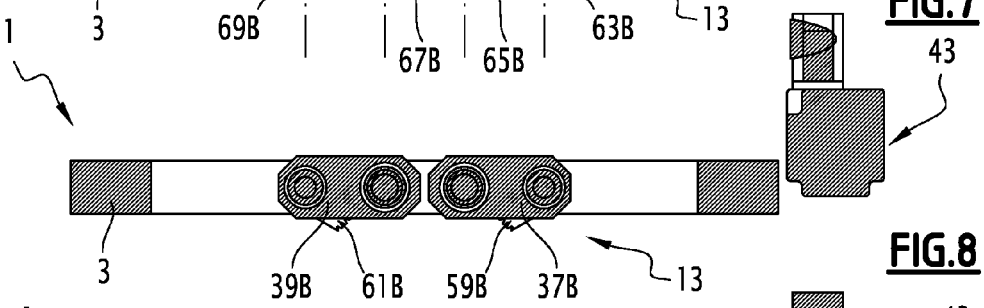

Each of the securing assemblies 47A, 47B (FIGS. 6 and 7) respectively comprises four gears 63A, 63B, 65A, 65B, 67A, 67B, 69A, 69B respectively secured to the four supports 25, 27, 29, 31.

The four gears 63B, 65B, 67B, 69B (FIG. 7) have substantially the same diameter and successively mesh in one another. By symmetry relative to the plane P', the same is true for the four gears 63A, 65A, 67A, 69A.

The gears 63A, 63B, 65A, 65B, 67A, 67B, 69A, 69B are respectively situated at opposite axial ends of the supports 25, 27, 29, 31.

The gears 63A, 65A, 67A, 69A respectively extend between the connecting rods 37A, 39A and the supports 25, 27, 29, 31 in the axial direction A.

The operation of the printing machine 1 will now be described.

The machine 1 is for example initially in the configuration shown in FIGS. 1 to 3, in which the printing directions D1, D2, D3, D4 are substantially parallel to each other. In this configuration, the printing machine 1 prints the surface 17 of the object 15. The object 15 is translated in the transverse direction T relative to the chassis 3.

The change in configuration of the printing machine 1 causing the printing heads 5, 7, 9, 11 to go from the position shown in FIGS. 1 to 3 to one of the positions similar to that shown in FIGS. 4 and 5 is done as follows.

Figure 11:
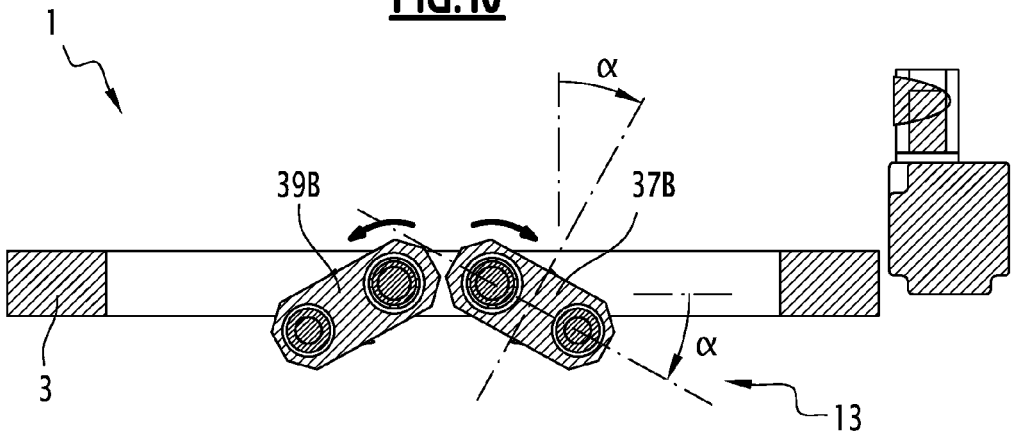

The reducing gear 49 drives the connecting rod 51 (FIG. 1), which in turn jointly rotates the connecting rods 37A, the moving axis 41A, support 5, the moving axis 41B and the connecting rod 37B around the main axes 33A, 33B relative to the chassis 3 by an angle $\alpha$ shown in FIG. 11.

Figure 12:
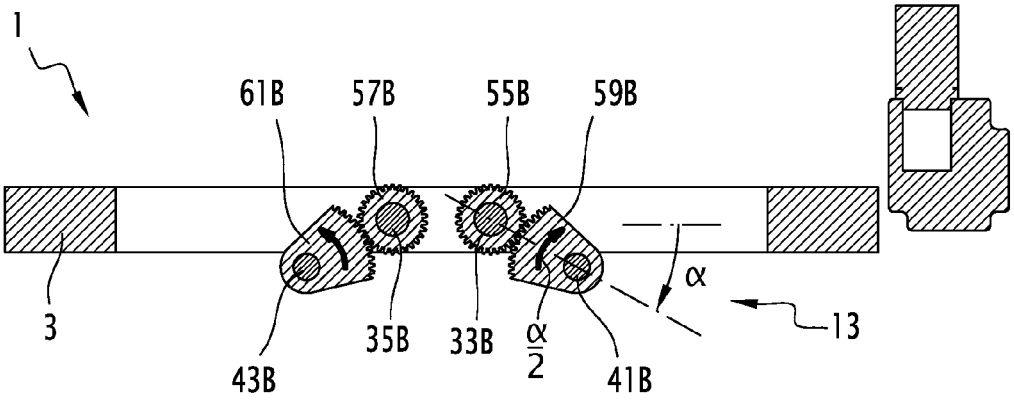

The regulating assemblies 45A, 45B are suitable so that, when the connecting rods 37A, 37B pivot by an angle $\alpha$ relative to the chassis 3 around the main axes 33A, 33B, respectively, the moving axes 41A, 41B pivot in the connecting rods 37A, 37B by an angle $\alpha/2$ relative to the connecting rods 37A, 37B. In fact, the toothed sector 59B goes from the position shown in FIG. 9 to that shown in FIG. 12. Because of its diameter, which is twice that of the pinion 55B, the toothed sector 59B pivots by an angle $\alpha/2$.

Since the pivoting by an angle $\alpha$ of the connecting rods 37A, 37B relative to the chassis 3 and the pivoting by an angle $\alpha/2$ of the moving axes 41A, 41B relative to the connecting rods 37A, 37B are combined, the moving axes 41A, 41B pivot by an angle $\alpha+\alpha/2$ relative to the chassis 3. Thus, the support 25, the printing head 5, the gears 63A, 63B and the printing direction D4 pivot by an angle $\alpha+\alpha/2$ relative to the chassis 3.

The securing assemblies 47A, 47B are suitable for the supports 25, 27, 29, 31 to be secured in rotation with each other around the main axes 33A, 33B, 35A, 35B and the moving axes 41A, 41B, 43A, 43B relative to the chassis 3, respectively. In fact, the pivoting by an angle $\alpha/2$ of the gear 63B (FIG. 10) relative to the connecting rod 37B causes pivoting of the gear 65B in the opposite direction by an angle $\alpha/2$. Thus, the gear 65B pivots by an angle $\alpha-\alpha/2$ relative to the chassis 3. The printing direction D2, secured to the gear 65B, also pivots by an angle $\alpha-\alpha/2$ relative to the chassis 3.

Figure 10:
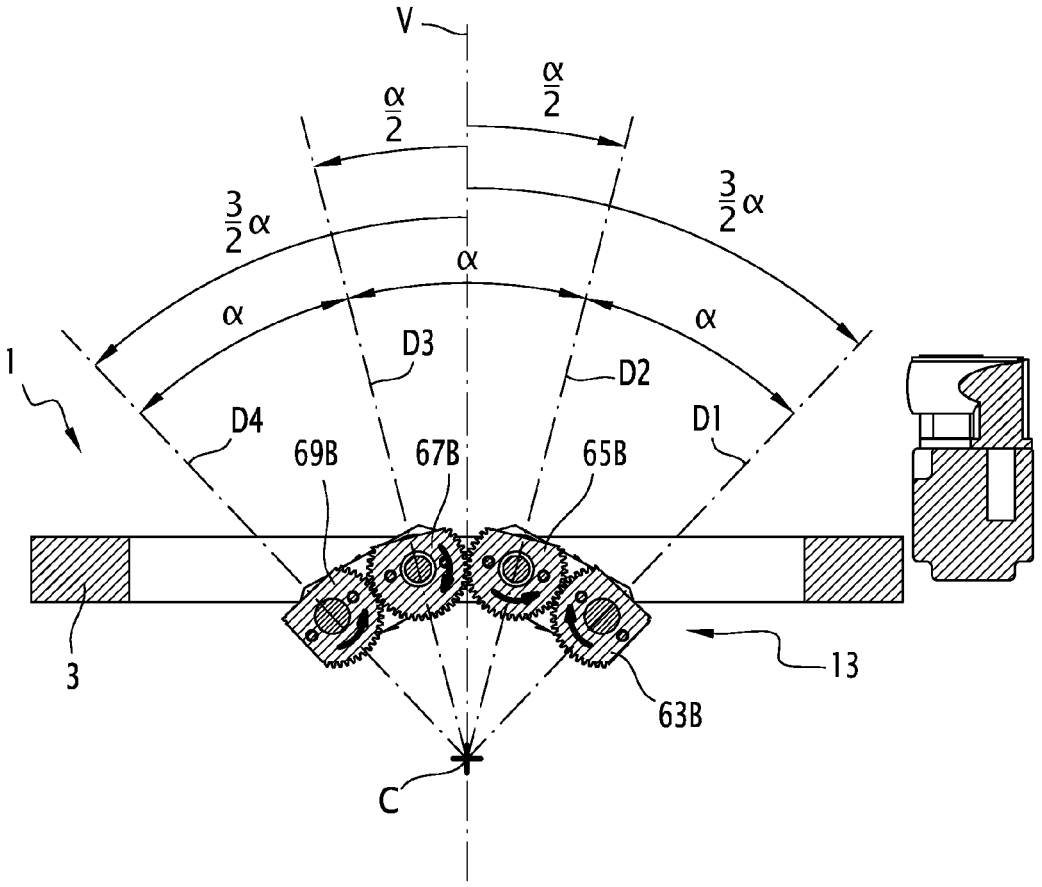
FIGS. 10 to 12 are cross-sections of the printing machine shown in FIGS. 1 to 9, in the same vertical planes as for FIGS. 7 to 9, the printing heads being in the position shown in FIG. 4.

By symmetry of the system 13, the printing directions D3 and D4 also respectively pivot by an angle $\alpha-\alpha/2$ and by an angle $\alpha+\alpha/2$ relative to the chassis 3 (FIG. 10). The printing directions D1, D2, D3, D4 are successively separated by a pitch with angle $\alpha$.

Because of the moving axes 41A, the main axes 33A, 35A and the moving axes 43A are successively separated by the same distance E, and the connecting rods 37A, 39A have pivoted by angles $\alpha$ relative to the chassis 3, the moving axis 41A, the main axes 33A, 35A, and the moving axis 43A being distributed in an arc of circle around a central axis C. Due to their respective orientations relative to the chassis 3, the printing directions D1, D2, D3, D4 converge toward the central axis C.

In the position shown in FIGS. 4 and 5, the printing machine 1 prints the surface 21 of the object 19, which is rotated around the central axis C relative to the chassis 3.

The larger the angle $\alpha$ is, the smaller the distance D between the central axis C and the chassis is. By varying the value of the angle $\alpha$, the printing heads 5, 7, 9, 11 are collectively moved from the position shown in FIGS. 4 and 5 to another similar position, which differs by the distance from the chassis 3 at which the central axis C is located. When the angle $\alpha$ is zero, the heads 5, 7, 9, 11 are in the position shown in FIGS. 1 to 3.

The printing machine 1 thus adapts to the radius of the object 19, without the successive distances between the moving axis 41A, the main axes 33A, 35A, and the moving axis 43A increasing.

Owing to the features described above, the printing machine 1 is suitable for cylindrical objects 19 with a large diameter or oval objects locally having a curved radius greater than or equal to 15 mm, as well as flat objects 15. Since the successive distances between the moving axes 41A, the main axes 33A, 35A, and the moving axis 43A do not increase between the different positions of the printing heads, the printing machine 1 is smaller, and therefore has a more moderate cost than the printing machines of the prior art.

Figure 13:
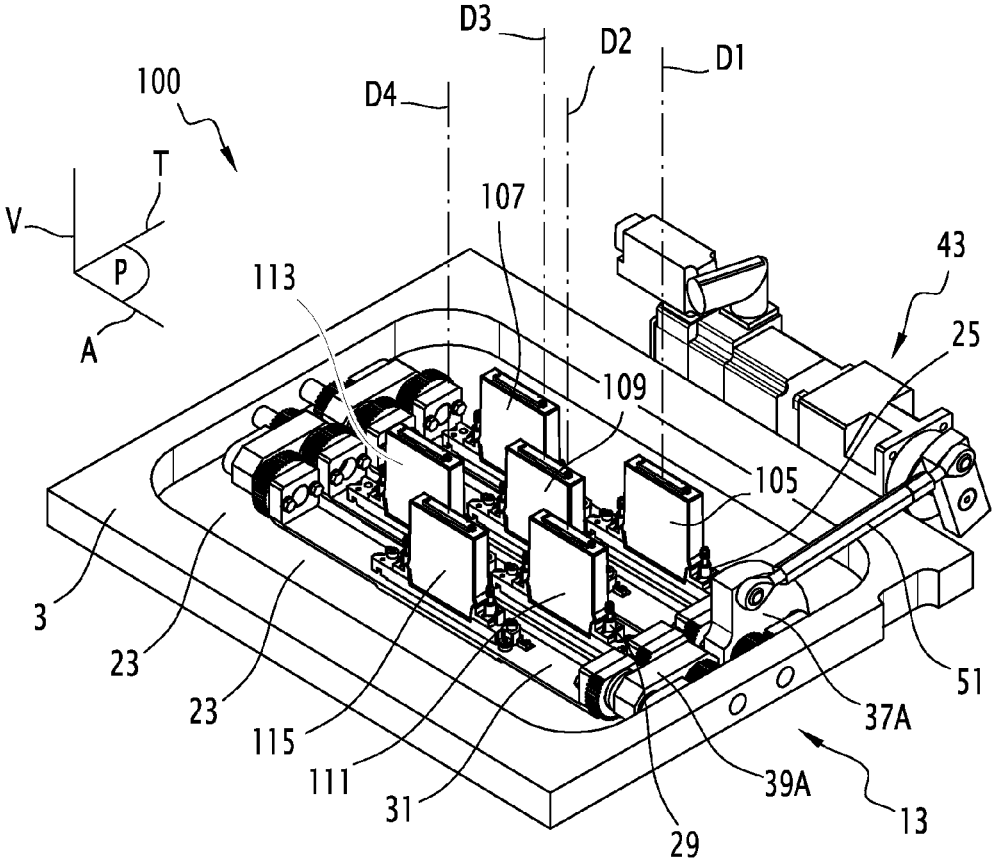
FIG. 13 is a perspective view of a printing machine according to another embodiment of the invention.
Figure 14:
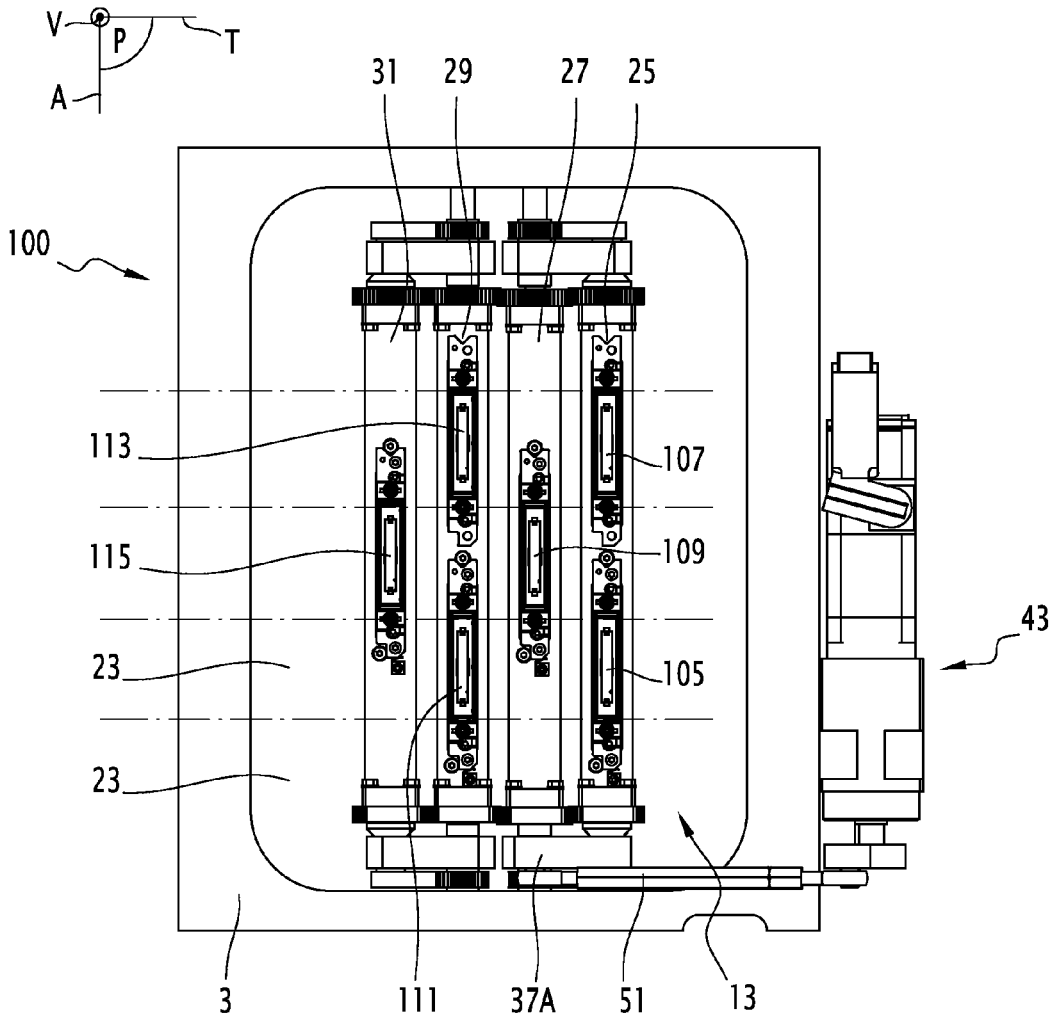
FIG. 14 is a top view of the printing machine shown in FIG. 13.

In reference to FIGS. 13 and 14, we will now describe a printing machine 100 that constitutes an alternative of the printing machine 1. The printing machine 100 differs from the printing machine 1 shown in FIGS. 1 to 12 in that it comprises six printing heads 105, 107, 109, 111, 113, 115 instead of four.

The other elements of the printing machine 100 are similar to those of the printing machine 1. The similar elements bear the same references as in FIGS. 1 to 12 and will not be described again.

In FIGS. 13 and 14, the system 13 is in the same configuration as in FIGS. 1 to 3, i.e., the printing directions D1, D2, D3, D4 are parallel to each other.

The printing heads 105, 107, 109, 111, 113, 115 are similar to the printing heads 5, 7, 9, 11 shown in FIGS. 1 to 3.

The printing heads 105, 107 are fastened on the support 25. The printing heads 105, 107 are aligned by the edge along the axial direction A.

Likewise, the printing heads 111, 113 are fastened on the support 31. The printing heads 111, 113 are aligned by the edge in the axial direction A. The printing heads 111, 113 are situated across from the printing heads 105, 107, respectively, in the transverse direction T.

The printing heads 109, 115 are respectively fastened on the supports 27, 29. The printing heads 109, 115 are for example situated across from one another in the transverse direction T. The printing head 109 is axially offset relative to the printing head 105 and the printing head 107 is axially offset relative to the printing head 109.

Thus, the printing head 109 is suitable for extending, in the axial direction A, a pattern (not shown) applied on the object 15 by the printing head 105 when the object 15 is moved transversely relative to the chassis 3. The printing head 107 is capable of extending, in the axial direction A, a pattern (not shown) applied on the object 15 by the printing head 109 when the object 15 is moved transversely relative to the chassis 3.

"Capable of extending a pattern in a direction" means that the printing head is suitable for applying a new pattern situated in the extension of the pattern on the object.

The printing heads 105, 107, 109 are for example configured to print patterns (not shown) of a same color. The printing heads 105, 107, 109 are advantageously positioned on the supports 25, 27 such that they print contiguous patterns (not shown) on the object 15 when the object 15 is translated relative to the chassis 3 in the transverse direction T.

Thus, the printing machine 100 makes it possible to print a pattern on the object 15 on an axial extension three times greater than the axial extension allowed by the machine 1.

The printing heads 111, 113, 117 are positioned on the supports 29, 31 similarly to the manner in which the printing heads 105, 107, 109 are positioned on the supports 25, 27. For example, the printing heads 111, 113, 117 are configured to print patterns (not shown) in a color different from that of the printing heads 105, 107, 109. Thus, by simultaneously using two machines similar to the printing machine 100, it is possible to produce a four-color printing process on the object 15, 19.

Alternatively, the printing heads 111, 113, 117 are configured to print patterns (not shown) with a color identical to that of the printing heads 105, 107, 109, for example white.

What is claimed is:

1. A machine for printing an object, the printing machine including:

a chassis, at least four inkjet printing heads respectively suitable for directing jets of ink toward the object in at least four printing directions, and a system for maintaining and moving printing heads fastened on the chassis and suitable for moving the printing heads between a plurality of positions relative to the chassis, wherein the system is suitable so that, in each of the positions of said plurality, the printing directions are separate from one another and pass through a same central axis, the central axes corresponding to the plurality of positions respectively situated at a plurality of distances from the chassis.

2. The printing machine according to claim 1, wherein the system is suitable for placing the printing heads in at least one position relative to the chassis in which the printing directions are substantially parallel to each other.

3. The printing machine according to claim 1, wherein the system is suitable so that, in each of the positions of said plurality, the printing directions are distributed angularly around the central axis with a constant angle pitch.

4. The printing machine according to claim 1, wherein the system comprises:

at least four supports on which the four printing heads are respectively fastened, at least two main axes that are substantially parallel to each other and secured to the chassis, two of the four supports being rotatably mounted around the two main axes, respectively, relative to the chassis, at least two connecting rods rotatably mounted relative to the chassis around the two main axes, respectively, at least two moving axes that are substantially parallel to the two main axes, the moving axes being rotatably mounted relative to the chassis in the two connecting rods, respectively, the other two of the four supports respectively being secured to the two moving axes, and a driving assembly for rotating at least one of the connecting rods around one of the main axes relative to the chassis.

5. The printing machine according to claim 4, wherein the system comprises at least one regulator assembly suitable, when the connecting rod driven by the drive assembly pivots by an angle relative to the chassis around the main axis, for pivoting the moving axis mounted in the driven connecting rod, the moving axis pivoting by an angle relative to the driven connecting rod.

6. The printing machine according to claim 5, wherein the regulator assembly comprises at least one pinion secured to the main axis around which the driven connecting rod pivots, and at least one toothed sector secured to the moving axis mounted in the driven connecting rod, the toothed sector meshing on the pinion and having a diameter equal to twice the diameter of the pinion.

7. The printing system according to claim 4, wherein the system comprises at least one securing assembly suitable for the supports to be secured to one another in rotation around the two main axes and the two moving axes relative to the chassis, respectively.

8. The printing machine according to claim 7, wherein the securing assembly comprises at least four gears respectively secured to the four supports, the four gears having substantially the same diameter and successively meshing in one another.

9. The printing machine according to claim 1, wherein the system is configured so that at least two of the printing heads are offset relative to one another along the central axis, such that one of said two heads is capable of extending a pattern, along the central axis, applied on the object by the other of the two printing heads.

10. The printing machine according to claim 9, wherein the system is configured so that said two printing heads are offset relative to one another along the central axis by a distance such that said two printing heads are capable of printing contiguous patterns on the object.

11. The printing machine according to claim 1, wherein the system is suitable for moving the printing heads collectively between the positions of said plurality of positions.

* * * * *